United States Patent [19]

Das

[11] 4,075,042

[45] Feb. 21, 1978

[54] SAMARIUM-COBALT MAGNET WITH GRAIN GROWTH INHIBITED $SMCO_5$ CRYSTALS

[75] Inventor: Dilip K. Das, Bedford, Mass.

[73] Assignee: Raytheon Company, Lexington, Mass.

[21] Appl. No.: 794,879

[22] Filed: May 9, 1977

Related U.S. Application Data

[63] Continuation of Ser. No. 416,700, Nov. 16, 1973, abandoned, which is a continuation of Ser. No. 131,777, April 6, 1971, abandoned, which is a continuation-in-part of Ser. No. 778,041, Nov. 22, 1968, abandoned.

[51] Int. Cl.[2] ..... H01F 1/02

[52] U.S. Cl. ..... 148/103; 148/31.57; 148/105; 75/152

[58] Field of Search ..... 148/101, 103, 105, 108, 148/31.57; 75/152

[56] References Cited

U.S. PATENT DOCUMENTS

| | | | |
|---|---|---|---|
| 3,421,889 | 1/1969 | Ostertag et al. | 75/160 |
| 3,463,678 | 8/1969 | Becker | 148/105 |
| 3,523,836 | 4/1970 | Buschow et al. | 148/31.57 |
| 3,540,945 | 11/1970 | Strnat et al. | 148/31.57 |
| 3,546,030 | 12/1970 | Buschow et al. | 148/31.57 |
| 3,596,350 | 8/1971 | Steingroever | 29/608 |
| 3,655,463 | 4/1972 | Benz | 148/101 |
| 3,663,317 | 5/1972 | Westendorp et al. | 148/103 |
| 3,684,591 | 8/1972 | Martin | 148/31.57 |
| 3,695,945 | 10/1972 | Benz | 148/103 |
| 3,723,197 | 3/1973 | Buschow et al. | 148/103 |

OTHER PUBLICATIONS

Westendorp, F.; Perm. Mags. with E.P. of 20 Million G.Oev, in Sol. State Comm., 1969, pp. 639–640.

Das, D.; Influence of Sint. Temp. on Mag. Prop. of Sm–Co Mags.; in I.E.E.E. Trans., 1971, pp. 432–435.

Young, J.; Materials and Processes, New York, 1954, pp. 690–693.

Kingery, W.; Ceramic Fabrication Processes, New York, 1958, p. 123.

*Primary Examiner*—Walter R. Satterfield

*Attorney, Agent, or Firm*—Harold A. Murphy; Joseph D. Pannone; John T. Meaney

[57] ABSTRACT

Permanent magnets formed from rare earth cobalt compounds have high energy products. One rare earth cobalt composition, formulated by metallurgical sintering techniques, is a composition of a rare earth and cobalt such as samarium and cobalt containing about 37.2 weight per cent samarium which corresponds to 60 proportions of $SmCo_5$ for each 40 proportions of $Sm_2Co_7$. This composition is an excellent permanent magnet having an energy product at least as high as $15 \times 10^6$ gauss-oersteds and up to $20 \times 10^6$ gauss-oersteds or higher. $SmCo_5$ contains roughly 33.8 weight per cent samarium, and $Sm_2Co_7$ about 42.2 weight per cent samarium; I have found that samarium-cobalt materials containing samarium between about 36.5 weight per cent and about 38 weight per cent are preferred and can be developed into magnets of greatly improved properties. The samarium-cobalt magnet of this invention is basically comprised of crystals of $SmCo_5$ and $Sm_2Co_7$ wherein the $SmCo_5$ crystals are surrounded by growth-inhibiting materials and are not larger than single domain size.

10 Claims, 1 Drawing Figure

Figure 1:
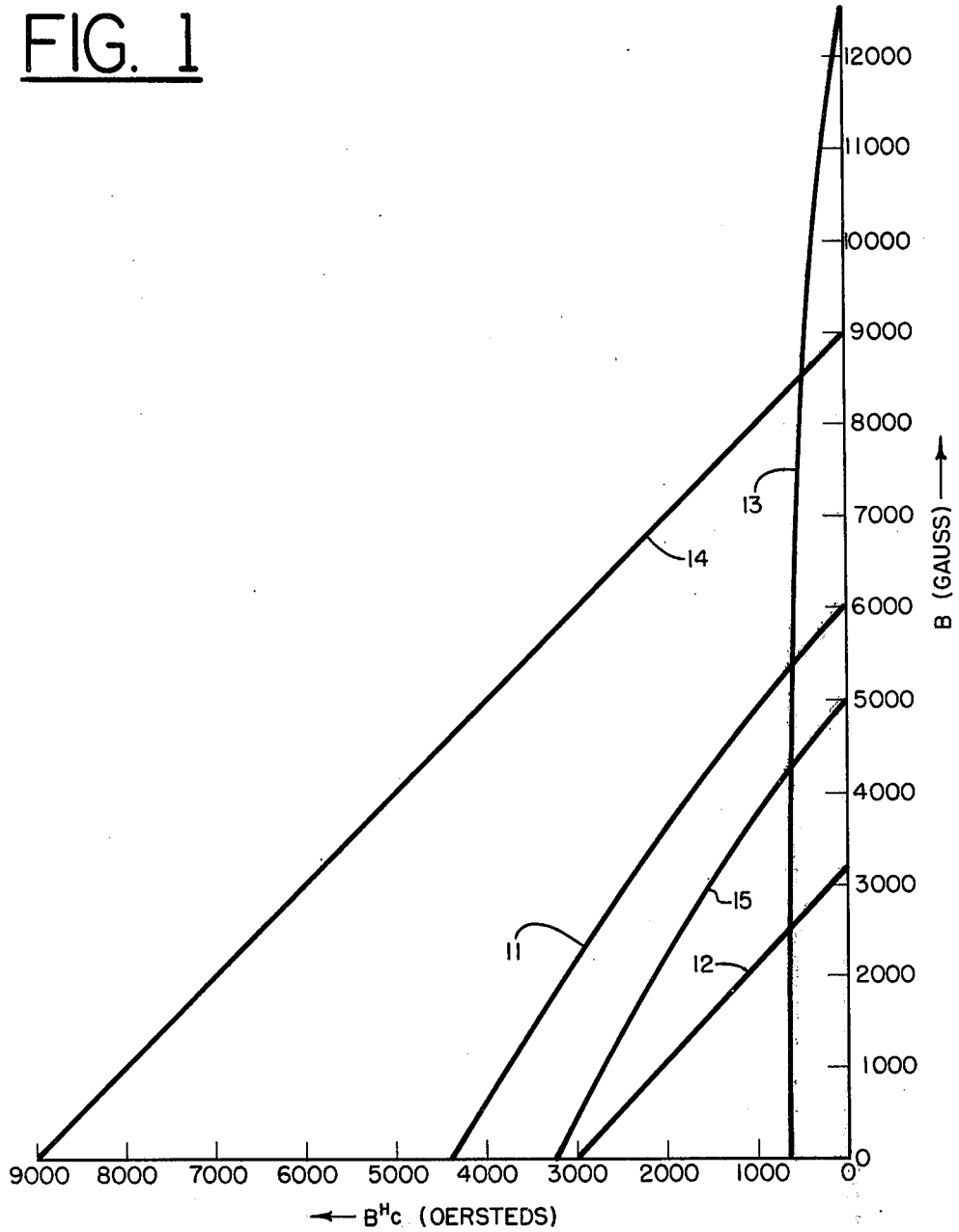

DILIP K. DAS
Inventor
By Joseph D. Pannone
Attorney

SAMARIUM-COBALT MAGNET WITH GRAIN GROWTH INHIBITED $SMCO_5$ CRYSTALS

CROSS-REFERENCE TO COPENDING APPLICATIONS

This application is a continuation of co-pending application Ser. No. 416,700 filed Nov. 16, 1973 and now abandoned, which was a continuation of application Ser. No. 131,777 filed Apr. 6, 1971 and now abandoned, which was a continuation-in-part of application Ser. No. 778,041 filed Nov. 22, 1968 and now abandoned.

DRAWINGS OF THE INVENTION

In FIG. 1 are illustrated graphs of magnetic properties of several materials according to the invention and according to the prior art.

BACKGROUND OF THE INVENTION

There is a constant need for improved permanent magnet materials which are stronger, more permanent, lighter in weight, and less expensive. These needs have sharply increased with miniaturization of electrical and electronic devices, and it is now more than ever desirable to produce extremely powerful, small sized and light weight permanent magnets. The need exists in such diverse fields as airborne and spaceborne electronic equipment, where one of the more important illustrative needs is for more powerful, smaller, lighter, permanent magnets for traveling wave tubes and the like, and in commercial products such as special motors, gyros, switches, hearing aids and other extremely small electric devices such as electric watches and the like. For example, there does not now exist a satisfactory permanent magnet for a ladies-sized watch, available at a commercially competitive price.

There are various properties sought in today's permanent magnet materials, including for example, coercive force, residual induction, thermal stability, Curie temperature, mechanical hardness, and the like. Assuming that desirable characteristics can be achieved for the other necessary properties, a particularly valuable combination is high residual induction, together with high coercive force such that the combination of these properties, otherwise known as the energy product, is as high as possible.

In FIG. 1, there is illustrated a combination of remanence and coercive force for one material of the present invention, and for several prior art materials. Included in the FIGURE is a curve designated 11, illustrating the properties of platinum cobalt, a highly desirable magnetic material, a curve 12, which is representative of ferrite material and a curve 13 which is typical of the alnico class of magnets, these three being prior art materials. Curve 14 illustrates like properties for a presently preferred material according to this invention. Curve 15 illustrates the same properties for $SmCo_5$ in the absence of $Sm_2Co_7$, and in unsintered condition.

Prior to the present invention, platinum cobalt material was the quality standard in the permanent magnetic material art. It has a very high coercive force of about 4,000 oersteds, and a remanence of about 6,000 gauss, and an energy product of approximately $9 \times 10^6$ gauss-oersteds. Where the need is for high performance, permanent magnetic materials justify the cost, as in the case of airborne and spaceborne equipment, platinum cobalt was indeed the material of choice, and it is the standard by which new promising materials should be measured in terms of absolute performance. The new magnets of the present invention, however, are so far superior that they now are the new standard of excellence.

Where the need is for a high quality, permanent magnet material available at a commercially realistic price, the ferrite materials have found substantial use and application. While significantly less satisfactory in performance than platinum cobalt, having energy products up to about $3.5 \times 10^6$ gauss-oersteds, they are, nevertheless, realistically recognized as being high performance materials, and are available at prices which are a small fraction of the cost of platinum cobalt. Where high permeability together with low stability is tolerable, a material such as Alnico-9 (illustrated in curve 13) is a very satisfactory magnetic material.

Recently, it has been found that certain rare earth combinations with cobalt are effective magnets and in particular, yttrium-cobalt mixtures corresponding to the proportions $YCO_5$ have a high theoretical potential, and practical yttrium-cobalt magnets have been produced with an actual energy product greater than $1 \times 10^6$ gauss-oersteds but less than $5 \times 10^6$ gauss-oersteds. Such magnets are disclosed for example, in Strnat U.S. Pat. No. 3,540,945.

DESCRIPTION OF THE INVENTION

Certain rare earth cobalt compositions have valuable magnetic properties and preliminary explorations with such compositions have been carried out, particularly with yttrium cobalt. Yttrium, although not strictly a member of the rare earth family, is, in many ways, similar to the rare earths and, accordingly, it is and has been recognized that promising properties observed in yttrium cobalt might be possessed by the rare earths generally. It has now been found, according to the present invention that not only do other of the rare earth cobalt compositions possess valuable magnetic properties, but that within certain limits and according to certain preferred procedures, some of the properties which have been only theoretically calculated can be now largely realized. The new and improved properties have been found with the compositions containing samarium and cobalt or containing other rare earth materials in combination with cobalt, either completely replacing samarium or in partial replacement of samarium. The new and valuable results of the invention have been determined and measured to a greater degree with samarium and cobalt alone and, accordingly, the description of the invention is primarily pres nted in terms of a samarium-cobalt composition.

It is calculable that samarium-cobalt magnets can have a combination of a number of magnetic properties, most forcefully and most understandably expressed in terms of an energy product, and that the calculable energy product of a samarium-cobalt magnet may be in excess of almost $23 \times 10^6$ gauss-oersteds even though the practical results actually achieved prior to the present invention have been rare earth cobalt magnets with energy products in the range of only 1 or $2 \times 10^6$ gauss-oersteds. According to the present invention, it has been determined that at least one of the problems associated with prior magnets and the problem which is solved by the present invention relates to the fact that efforts to produce samarium-cobalt magnets have produced multiple domain rather than single domain particles.

Dealing with samarium-cobalt compositions, it has been found that $SmCo_5$ has an extremely high calculable or theoretical energy product, but that as a hard fact of practical result, this energy product cannot be achieved in a magnet of $SmCo_5$ according to the prior skills in the art. For example, it is recognized that small particle or crystal size is desirable in order to produce single domain particles, and if a composition of $SmCo_5$ is subdivided into fine particles and formed into a magnet, the desired high energy product cannot be achieved. This is in part because of the voids in an article formed in such a manner and also because of surface and lattice defects introduced into the particles during pulverizing operations to produce fine powders for massive alloys. But, if efforts are made to reduce the voids and eliminate the defects, the results are no more encouraging. It has now been found that actual magnetic properties measurable by performance of the magnets themselves can be readily achieved, that such magnetic properties can be represented by an energy product consistently well in excess of $15 \times 10^6$ gauss-oersteds, and that according to preferred procedures, such energy products in fact can be in excess of $20 \times 10^6$ gauss-oersteds. The results have been achieved by employing not $SmCo_5$ alone, which theoretically has excellent magnetic properties, nor employing the next adjacent recognized crystalline forms of samarium and cobalt, namely $Sm_2Co_7$ or $Sm_2Co_{17}$, but by employing the samarium and cobalt in the percentage composition which does not correspond to any single crystalline form, namely, between the composition of $SmCo_5$ and $Sm_2Co_7$ by forming such a mixture into extremely fine particles which are then compacted and formed into a unitary structure by a suitable method. The presently preferred method is by sintering.

Prior experience with sintering samarium-cobalt magnetic compositions has been that during a sintering operation process, there is grain growth with the result that the grains exceed single domain sizes and impair the magnetic properties by introducing domain walls into individual particles. The preferred samarium-cobalt material can be formed into a magnet by sintering and the magnetic properties of the resulting magnet are greatly better than the properties that can be achieved in actual practice from either $SmCo_5$ or $Sm_2Co_7$. The magnetic properties are evidenced in various magnetic measurements but can very simply be expressed in terms of an energy product greater than $15 \times 10^6$ gauss-oersteds. Similar results have been found with other rare earths in combination with samarium and cobalt and excellent magnets can be formed with rare earth cobalt combinations corresponding to the desired range between $RCo_5$ and $R_2Co_7$, where R represents a rare earth such as samarium, praseodymium, lanthanum or cerium or another such rare earth in which samarium represents about one-half or more of the total rare earth composition. Such a composition including samarium and another rare earth such as praseodymium in combination with the desired cobalt material has been found to be almost as good as samarium and cobalt alone. Praseodymium, cerium and lanthanum have been successfully employed, and in each case, it has been found that the corresponding mixture of $RCo_5$ plus $R_2Co_7$ has a higher energy product than either $RCo_5$ alone or $R_2Co_7$ alone.

A samarium-cobalt crystal represented by the composition $SmCo_5$ has a samarium content of 33.8% by weight and a cobalt content of 66.2%. A samarium-cobalt composition corresponding to $Sm_2Co_7$ has 42.2% samarium by weight and 57.8% cobalt. It has been found that the compositions of the present invention contain between 35 and 42 weight percent samarium, the remainder being cobalt. Preferred compositions represent between about 35 and 45 percent $Sm_2Co_7$ with the remainder being about 65 to about 55 percent $SmCo_5$; in percentage by weight, this is between about 36.5% and about 38% samarium and the remainder cobalt. A presently preferred composition is about 60 percent $SmCo_5$ and about 40 percent $Sm_2Co_7$ or about 37.2% by weight samarium and about 62.8% by weight cobalt. It is observed that the nature of the invention is more clearly understood by considering the mixture of cobalt and samarium as mixtures of $SmCo_5$ crystals and $Sm_2Co_7$ crystals, but it is believed to be more definitive to consider the composition in terms of percent by weight in the final composition.

The presently preferred method of making the magnets comprises forming a mixture of samarium and cobalt in the desired proportions, melting and mixing to be sure that homogeneous mixing has occurred, and then cooling the melted alloy to room temperature. The samarium-cobalt material is then finely divided to a fine powder which may be accomplished by various grinding procedures. The powder is then formed into a desired shape in the presence of a strong magnetic field, after which it is sintered at a temperature of about 1100° C. The magnet is then cooled after which it may be further formed or machined. It is again magnetized along the same magnetic direction as employed during the magnet formation, with or withour reversing the magnetic poles.

In this sintering operation, it is desired to raise the temperature slowly to the sintering temperature, and subsequently cool slowly, so as to avoid thermal shock. It is important to maintain careful temperature control during the sintering operation.

EXAMPLE I

Samarium and cobalt, in the desired proportions such as for example 37.2% samarium and 62.8% cobalt, are placed in a container or vessel which is not reactive with either of the materials. A slight excess of samarium is employed depending on the size of the total mixture. With 50 gram mixes, about 39% samarium has been found appropriate, whereas with kilogram mixes, only a negligible amount of excess samarium is required. Alumina is suitable for the container or vessel. The samarium and cobalt are heated well above the melting point, about 1500° C. being satisfactory, and are held in a molten condition for a few minutes to be sure that homogeneous mixing has occurred. It is preferred that this step be carried out in a controlled atmosphere, such as a noble gas such as helium, or the like. It has been found satisfactory to carry out this step at atmospheric pressure.

The molten samarium-cobalt material is cooled to room temperature, and may or may not be cast, as desired. The solid material of samarium and cobalt is then ground to a fine powder having a particle size less than the single domain particle size for $SmCo_5$ which is about 10 microns. The material is brittle and grinds easily. The grinding step may be carried out in a slurry. The resulting samarium-cobalt powder is compacted to the desired shape under high pressure. Satisfactory compacting can be attained at about 50 tons per square inch, although, of course, either higher or lower pressure may be used. A magnetic field in a predetermined direction is applied during compacting; the particles are thus aligned along a preferred magnetic direction. Vibration during the compacting appears to improve mechanical uniformity of the product, but satisfactory magnets are obtained without vibration. The resultant compact is already a permanent magnet.

Magnets of the highest quality are obtained by continuing the processing as follows. First the magnet as formed above preferably is demagnetized by a reverse magnetic field. If an electromagnet has been used to apply the magnetic field during the compacting operation, demagnetization can be obtained by reversing the electromagnet in the mold. Otherwise, a separate demagnetization step is desired. After demagnetization, the compact is sintered, the temperature being raised slowly to a temperature between about 1100° C. and about 1136° C. In actuality, a temperature of about 1110° C. is usually employed in an inert atmosphere such as a noble gas. For the sintering operation, the furnace material and vessel in which the magnetic material is carried is one which is not reactive to samarium. After the material has been sintered for about an hour, it is cooled slowly to room temperature.

After it has been cooled to room temperature, the magnetic material is again magnetized along the same or opposite direction as was employed in the compacting step.

The magnet thus formed has an intrinsic coercive force of about 25,000 oersteds or better, and an energy product greater than $16 \times 10^6$ gauss-oersteds. In the FIGURE, curve 14 illustrates the coercive force and remanence of this magnet in comparison with prior art materials illustrated by curves 11, 12 and 13.

On microscopic examination, the magnetic material is seen to consist of two phases or two distinct crystal forms. It is believed that one crystal form comprises essentially $SmCo_5$ and the other crystal form comprises essentially $Sm_2Co_7$. There are almost no voids between the particles or crystals, the density being well over 90% theoretical density. It is now believed that the improved result relates to the fact that the material comprises intermixed particles essentially without interconnection voids; the one particle being a high energy product crystalline compound $RCo_5$, and the other being a ferromagnetic crystalline product of lower energy product, intermixed in finely dispersed discrete crystal phase, and being of adjacent chemical or molecular composition.

The process herein described has been employed for the formation of a number of magnets having compositions in the range between 34 weight percent samarium and 42 weight percent samarium. The highest energy products, as high as between $15 \times 10^6$ gauss-oersteds and $20 \times 10^6$ gauss-oersteds, have been found in compositions containing between 36.5 weight percent samarium and 38.0 weight percent samarium, and at least some degree of improved properties have been found throughout the entire range between $Sm_2Co_7$ and $SmCo_5$. In Table I are shown illustrative measures of magnetic strength of a series of magnets prepared from different ratios of samarium and cobalt, according to the procedure set forth herein. The series of magnets was analyzed in a configuration appropriate in a periodic permanent magnet (PPM) array for a travelling wave tube. Peak axial field has a definite relationship to energy product, especially the intrinsic energy product ($4\pi$ MH) max and is a measure of both coersivity and induction for a principal utilization of the magnets of this invention and a utilization in which the most significant property is the peak axial field. Accordingly, the data recorded in the table relate to that property. The compositions in the table are presented in terms of equivalent percent of $Sm_2Co_7$ for purposes of clarity. A composition equivalent to 40% $Sm_2Co_7$ and 50% $SmCo_5$ contains 37.2% samarium and 62.8% cobalt by weight. It is judged for this purpose that the range between about 35 percent $Sm_2Co_7$ and 50 percent is preferred, and that the most favorable peak axial field was achieved at about 40 percent $Sm_2Co_7$ (37.2% by weight samarium). Less than 30 percent $Sm_2Co_7$ was inadequate; in other tests, it has been found that a magnet corresponding to more than 60 percent $Sm_2Co_7$ and less than 40 percent is only slightly more powerful than a magnet prepared from $SmCo_5$ alone.

TABLE I

Peak Axial Field (Gauss)

| Equivalent Composition | | Peak Axial Field |
|---|---|---|
| $Sm_2Co_7$ | $SmCo_5$ | In Gauss |
| 0 | 100 | 400 |
| 26 | 74 | 550 |
| 30 | 70 | 1000 |
| 35 | 65 | 3400 |
| 40 | 60 | 3600 |
| 45 | 55 | 3400 |
| 50 | 50 | 2500 |
| 100 | 0 | 1700 |

It is not intended to limit the scope of this invention to a theoretical explanation of a mechanism, but by way of explanation, it is believed that the final magnet includes crystals of $SmCo_5$ of less than single domain size bounded by $Sm_2Co_7$ or similar form of samarium-cobalt material. Moreover, this explanation is consistent with the behavior of other rare earth-cobalt magnets in which lanthanum-cobalt, cerium-cobalt and praseodymium-cobalt magnets have been found to exhibit the same phenomenon in mixtures of compositions corresponding to $RCo_5$ plus $R_2Co_7$. In each case, a mixture of $RCo_5$ together with the next adjacent, lower melting form $R_2Co_7$ has a higher energy product than the energy product of $RCo_5$ alone.

As it is now understood, an important achievement of this invention is the densification of the compact, which increases the magnetization while not allowing the individual particles to grow large enough to become multidomain structures. In the pressed but unsintered condition, the powder has a coercivity which is quite low compared to the 25 KOe coercivity in the sintered magnets. This coercivity is achieved and other magnetic properties maintained or improved through the removal of surface defects and lattice defects of the particles by the high temperature treatment of the sintering operation. But removal of these defects would not by themselves be enough unless at the same time the individual particles comprising the magnet body were kept small enough so that no domain walls would be present. That is, not only must surface and lattice defects be removed, but while densifying the compact, particle size must also be maintained so that each particle remains equal to or smaller than the maximum single domain size.

In a single phase alloy that is not possible, simply because the adjacent particles are identical chemically and crystallographically and some individual crystallites will grow at the expense of their neighbors. This does not happen in the magnets of the present invention where the neighbors are dissimilar. No substantial grain growth would occur if the neighbors were sufficiently different from each other. And that is the situation that has been introduced in the samarium-cobalt magnet of this invention. An $SmCo_5$ particle has an $Sm_2Co_7$ particle for a neighbor and vice versa. Densification occurs giving rise to higher magnetization, and coercivity increases because of removal of defects but is not hurt by formation of domain walls within individual particles since they are maintained smaller than single domain size.

I claim:

1. A rare earth-cobalt magnet of a rare earth designated by the symbol R comprising a shaped sintered structure of fine particles of rare earth and cobalt corresponding to the mixture of $RCo_5$ and $R_2Co_7$, said structure having an energy product greater than the actual energy product of $RCo_5$ or $R_2Co_7$, each taken alone, wherein R is a rare earth selected from the group consisting of samarium, cerium, praesodymium and lanthanum, and consisting essentially of grains of $RCo_5$ of single domain size and at least partially surrounded by crystallized $R_2Co_7$.

2. A rare earth-cobalt magnet comprising a sintered body of sintered fine particles of rare earth and cobalt corresponding to a mixture of $RCo_5$ and $R_2Co_7$, wherein R is a rare earth selected from the group consisting of samarium, cerium, praesodymium, lanthanum and mixtures thereof, said magnet having an energy product greater than the energy product of a sintered body of either $RCo_5$ or $R_2Co_7$, each taken alone, and having a coercive force greater than about 25,000 gauss and an energy product greater than $15 \times 10^6$ gauss-oersteds, said sintered magnet consisting of crystallized grains of $RCo_5$ at least largely surrounded by crystallized $R_2Co_7$, and limited in grain size to single domain size.

3. A rare earth-cobalt magnet having a coercive force greater than about 25,000 gauss and an energy product greater than $15 \times 10^6$ gauss-oersteds, comprising a sintered body of sintered fine particles of rare earth and cobalt corresponding to a mixture of $RCo_5$ and $R_2Co_7$, wherein R is a rare earth selected from the group consisting of samarium, cerium, praesodymium, lanthanum and mixtures thereof, said magnet having an energy product greater than the energy product of a sintered body of either $RCo_5$ or $R_2Co_7$, each taken alone, and said sintered magnet consisting of crystalline grains of $RCo_5$ at least partially separated by growth-inhibiting crystalline rare earth material, and limited in grain size to single domain size.

4. A magnet having a coercive force greater than about 25,000 gauss and an energy product greater than $15 \times 10^6$ gauss-oersteds and greater than the energy product of a magnet whose composition corresponds to $SmCo_5$ alone or $Sm_2Co_7$ alone, said magnet consisting essentially of sintered samarium and cobalt and containing samarium in an amount between 36.5% and 38% based on the total weight of samarium and cobalt, said magnet being a cohesive, magnetized, shaped structure of samarium and cobalt and consisting essentially of crystalline grains of $SmCo_5$ of less than single domain size at least largely surrounded by crystallized $Sm_2Co_7$.

5. A rare earth cobalt magnet comprising a sintered body of sintered fine particles of rare earth and cobalt corresponding to a mixture of $SmCo_5$ and $Sm_2Co_7$, said magnet having an energy product greater than the energy product of a sintered body of either $SmCo_5$ or $Sm_2Co_7$ each taken alone, and having a coercive force greater than about 25,000 gauss and an energy product greater than $15 \times 10^6$ gauss-oersteds, said sintered magnet consisting of crystalline grains of $SmCo_5$ at least largely surrounded by crystalline $Sm_2Co_7$ and limited in, grain size to single domain size.

6. A sintered samarium cobalt magnet having a coercive force greater than about 25,000 gauss and an energy product greater than $15 \times 10^6$ gauss-oersteds and greater than the energy product of a sintered $SmCo_5$ magnet or of a sintered $Sm_2Co_7$ magnet each taken alone, said magnet consisting essentially of about 37.2% by weight samarium and 62.8% by weight cobalt, said composition thereby lying in a range between that of $SmCo_5$ and that of $Sm_2Co_7$, said magnet comprising a sintered body of compacted powder of samarium and cobalt of an average particle size less than about 10 microns, said sintered product consisting of grains limited to single domain size of $SmCo_5$ essentially surrounded by $Sm_2Co_7$.

7. A rare earth-cobalt magnet having a coercive force greater than about 25,000 gauss and an energy product greater than $15 \times 10^6$ gauss-oersteds, comprising a sintered body of fine particles comprising primarily crystals of $SmCo_5$ not larger than single domain size and separated by a different crystalline growth-inhibiting rare earth material.

8. A method of forming a magnet having a coercive force greater than about 25,000 gauss and an energy product greater than $15 \times 10^6$ gauss-oersteds, said method comprising uniformly mixing particles having an average particle size less than about 10 microns of a material having a composition of between about 36.5% samarium and 38% samarium, the remainder being cobalt; compacting the mixed particles into a shaped structure in a magnetic field along a predetermined direction; sintering said shaped structure, thereby causing the particles to be cohesively secured together to produce a magnet having grains of $SmCo_5$ of size limited to single domain size largely surrounded by crystallized $Sm_2Co_7$; and finally magnetizing the formed structure along the same predetermined direction.

9. A method of forming a magnet having a coercive force greater than about 25,000 gauss and an energy product greater than $15 \times 10^6$ gauss-oersteds, said method comprising melting a rare earth-cobalt composition of between about 36.5% samarium and 38% samarium, the remainder being cobalt; cooling said melt, subdividing the product into particles having an average particle size less than about 10 microns, compacting the particles into a shaped structure in a magnetic field along a predetermined direction, sintering said shaped structure to form a magnet body consisting essentially of grains of $SmCo_5$ of single domain size largely surrounded by crystallized $Sm_2Co_7$, and finally magnetizing the formed structure along the same predetermined direction.

10. A method of forming a magnet having a coercive force greater than about 25,000 gauss and an energy product greater than $15 \times 10^6$ gauss-oersteds, said method comprising melting in a noble gas atmosphere a samarium-cobalt composition of about 37.2 weight percent samarium and about 62.8 weight percent cobalt, cooling said melt, subdividing the product into powder particles having an average particle size less than about 10 microns, compacting said powder particles into a shaped magnet structure under a pressure of about 50 tons per square inch in a magnetic field applied in a predetermined direction, demagnetizing the thus formed shaped magnet structure, sintering the shaped magnet structure in a noble gas atmosphere at a temperature of about 1110° C for about 1 hour, thereby producing a mechanically coherent magnet structure comprising grains of single domain size of $SmCo_5$ essentially surrounded by $Sm_2Co_7$, and magnetizing the sintered coherent magnet structure in said predetermined direction.

* * * * *